US005434030A

United States Patent [19]

Smith et al.

[11] Patent Number: 5,434,030

[45] Date of Patent: Jul. 18, 1995

[54] TONER COMPOSITIONS CONTAINING COMPLEXES OF IONIC DYES AND IONOPHORIC OR IONOMERIC POLYMERS

[75] Inventors: Thomas W. Smith, Penfield; David J. Luca, Rochester; Kock-Yee Law, Penfield, all of N.Y.

[73] Assignee: Xerox Corporation, Stamford, Conn.

[21] Appl. No.: 313,956

[22] Filed: Sep. 28, 1994

[51] Int. Cl.[6] ..... G03G 9/09

[52] U.S. Cl. ..... 430/106; 430/110

[58] Field of Search ..... 430/106, 110

[56] References Cited

U.S. PATENT DOCUMENTS 4,592,989 6/1986 Smith et al. ..... 430/110

4,652,508 3/1987 Ober et al. ..... 430/110 X 4,925,763 5/1990 Tsubuko et al. ..... 430/106

5,200,290 4/1993 Ong et al. ..... 430/106 X 5,314,778 5/1994 Smith et al. ..... 430/111

FOREIGN PATENT DOCUMENTS 1231856 5/1971 United Kingdom ..... 430/106

*Primary Examiner*—Roland Martin

*Attorney, Agent, or Firm*—Oliff & Berridge

[57] ABSTRACT

A toner composition includes a resin, a charge enhancing additive, an ion binding polymer, and at least one ionic dye complexed to the ion binding polymer. The ionic dye is different from the charge enhancing additive and is stabilized and dispersed in the toner composition.

27 Claims, 1 Drawing Sheet

TONER COMPOSITIONS CONTAINING COMPLEXES OF IONIC DYES AND IONOPHORIC OR IONOMERIC POLYMERS

BACKGROUND OF THE INVENTION

This invention is generally directed to toner compositions and developer compositions, and the use of these compositions in electrostatographic imaging systems including color imaging processes. More specifically, the present invention is directed to toner compositions containing therein ionic dyes bound to ionophoric or ionomeric polymers. These ion binding segments are effective in incorporating salts and ionic dyes into dielectric resins and cause the toner particles to assume a positive or negative triboelectric charge. The resulting toners are non-toxic and are thermally and photochemically stable. The toner and developer compositions of the present invention are particularly useful in electrostatographic imaging systems and in colored imaging processes.

Electrostatographic processes are well known in the art. For example, U.S. Pat. No. 4,592,989 discloses an electrostatic toner composition comprised of resin particles, pigment particles and a complex of a dipolar molecule or salt attached to an ionophoric polymer, and a method for using such toner compositions in electrostatographic processes.

Use of ionophoric and ionomeric resins in toner and developer compositions has not met with extensive applications. However, use of such resins in toner and developer compositions is known in the art. For example, U.S. Pat. No. 4,592,989, described above, discloses ionophoric polymers as charge enhancing additives. U.S. Pat. No. 5,314,778 discloses ionomeric polymers, optionally complexed to a Lewis acid, a salt, or an ion thereof, as charge enhancing additives in toner compositions. U.S. Pat. No. 4,925,673 discloses a toner composition comprising a colorant synthesized from a pigment component, an ionomeric resin and, optionally, a humic acid component. However, the dyes and pigments are covalent in their bonding nature, and therefore do not interact with the ionomeric polymer in the way that ionic dyes would interact.

A recognized problem in prior art toner and developer compositions is that high quality color images require that toner colorants be pigments of colloidal dimensions, or dyes solubilized in the toner resin. However, reduction of pigments to colloidal dimensions usually requires special milling and grinding operations, coupled with flushing processes. Resin-soluble dyes are an alternative approach; however, such dyes are generally less stable than pigments, and dye-based images tend to degrade rapidly when exposed to ambient conditions in most office environments. Generally, such resin-soluble dyes are less stable than pigments in their environmental, thermal and photochemical characteristics. A need therefore continues to exist to provide better methods for incorporating colorants into toner compositions, or to provide more stable dyes that degrade less rapidly.

One approach to increase the stability and usefulness of soluble dyes has been utilized in the area of silver halide photography. In that art, dyes are typically bound to polymers and mordants to enhance the heat, light and environmental stability of the dyes. Here, mordant refers to a chemical used for fixing colors on textiles by absorption. For example, mordants may include soluble salts of aluminum, chromium, iron, tin and antimony. The dyes are often then "laked" with salts or substances such as phosphotungstic or phosphomolybdic acid to render them insoluble and stable. Here, laking refers to interacting a soluble dye with a precipitant and an absorptive substrate, typically resulting in a pigment-type composition.

A further recognized problem with pigments and dyes is that such pigments and dyes tend to have a dominant effect on the charging characteristics of a toner or developer composition. Therefore, the charging characteristics, such as triboelectric charging, of a toner or developer composition varies depending on the specific pigments or dyes incorporated therein. Thus, even a slight change in the color component of a toner or developer composition alters the charging characteristics and requires that the charging components be redesigned. Accordingly, there exists a continued need for improved toner and developer compositions with charging characteristics that are less dependent upon the specific pigments or dyes incorporated therein.

SUMMARY OF THE INVENTION

The present invention provides improved toner and developer compositions for use in electrostatographic imaging processes. The invention provides soluble ionic dyes that can be bound to ionophoric or ionomeric segments of block copolymers, and the resulting complexes of ionic dyes and block copolymer can be homogeneously dispersed in specific toner resins to yield transparent toner compositions.

The improved toner and developer compositions of embodiments of the present invention provide advantages over prior art compositions. For example, the toner compositions of the present invention exhibit increased color strength, and may incorporate higher concentrations of dye, resulting in improved imaging processes. Also, the soluble dye in the toner composition is stabilized by being bound to the ionophoric or ionomeric segment of the ion binding polymer, and therefore produces a dye-based toner composition with increased environmental, thermal and photochemical stability.

A further advantage of toner compositions of the present invention is that the charging characteristics of the toner composition are less dependent upon the specific dye incorporated in the toner. Instead, the charging characteristics of the toner composition are primarily determined by the nature of the ionophoric or ionomeric segment of the ion binding polymer and are secondarily related to the molecular and dielectric properties of the dyes and other salts complexed thereto. Thus by proper selection of the ion-binding polymer itself, the bulk charging properties of the toner may be controlled. Furthermore, by proper selection of charge enhancing additives, which are preferably different from the ionic dye(s) and are either complexed to the polymer or blended onto or into the toner composition, the admix properties of the toner may be improved. The charging and admix characteristics of such ionophoric and ionomeric segments of polymers are disclosed in U.S. Pat. Nos. 4,592,989 and 5,314,778, the entire disclosures of which are hereby incorporated by reference.

Because the polymer complex primarily controls the charging characteristics of the toner composition, multiple dyes may be incorporated into a single toner to provide any desired color, yet without altering the charging properties. For example, the relative proportions of cyan, magenta, and yellow dyes in a toner may be altered to adjust the color of the toner, without having to reformulate the charging characteristics. In addition, cyan, magenta, yellow and black toner compositions, prepared with the same ionophoric or ionomeric polymer, can have nearly identical charging characteristics. This simplifies developer design and development processes employed in process color or highlight color electrostatographic devices.

Specifically, this invention provides a toner composition comprising a resin, a charge enhancing additive, an ion binding polymer, and at least one ionic dye complexed to the ion binding polymer, wherein said ionic dye is different from the charge enhancing additive and is stabilized and dispersed in the toner composition.

BRIEF DESCRIPTION OF THE DRAWINGS

FIG. 1(*b*) shows an anionic dye complexed to an ionomeric polymer.

FIG. 2(*b*) shows a cationic dye complexed to a polymer segment.

DETAILED DESCRIPTION OF PREFERRED EMBODIMENTS

Figure 1A:
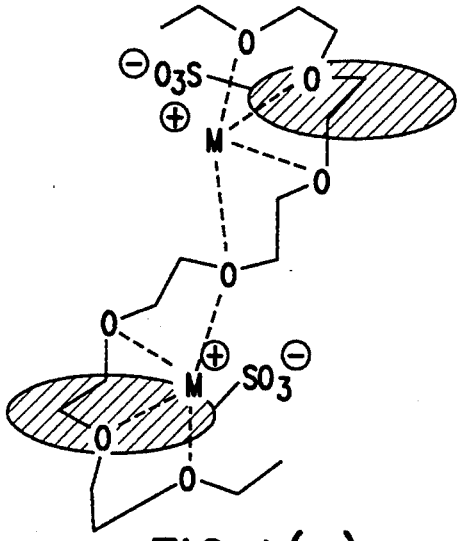
FIG. 1(*a*) shows an anionic dye complexed to an ionophoric polymer.

The present invention provides electrostatic toner compositions comprised of a host thermoplastic polymeric resinous material and a complex of dye bound or attached to an ionophoric or ionomeric polymer. The present invention also provides developer compositions comprising a complex of dye bound to an ionophoric or ionomeric polymer. A further embodiment of the present invention provides developer compositions comprised of toner resin particles, carrier particles and a complex of dye bound to an ionophoric or ionomeric polymer.

In general terms, the toner and developer compositions of the present invention may be made by complexing an ionic dye to an ionophoric or ionomeric polymer, and then dispersing the resultant polymer into a toner resin to yield a final toner composition. Although it is not a requirement, the ionophoric or ionomeric block copolymer is preferably a separate component from the toner resin. The toner composition may include other internal and/or external additives, and may optionally be mixed with carrier particles to yield a developer composition.

In one embodiment of the present invention, an anionic dye is bound to an ionophoric polymer. For example, a block copolymer of polystyrene and poly(oxyethylene) is complexed with an appropriate metal salt of a sulfonated azo dye such as Acid Yellow 40. In this example, the metal salt may include $K^+$, $Rb^+$, $Mg^{2+}$, $Zn^{2+}$, $Al^{3+}$, etc. The resulting polymer is a colloidal solution of dye bound to the poly(oxyethylene) phase of the block copolymer. This complex is easily dispersed in a styrenic toner resin to produce a yellow toner composition.

In another embodiment of the present invention, an anionic dye is bound through ion exchange binding to a cationic polyelectrolyte. This ion exchange bonding is also referred to as a disproportionation reaction. For example, a block copolymer of polystyrene and poly(2-vinylpyridinium chloride) may undergo a disproportionation reaction with an anionic dye such as copper phthalocyanine tetrasulfonic acid tetrasodium salt. The result of the disproportionation reaction is a colloidal solution of the dye bound to the poly(2-vinylpyridinium) segment of the block copolymer. This complex is easily dispersed in a styrenic toner resin to yield a cyan colored toner composition.

In a third embodiment of the present invention, a cationic dye is bound to an ionophoric polymer. For example, a block copolymer of polystyrene and poly(oxyethylene)is complexed with a dye such as Auramine 0 by virtue of hydrogen bonding between the protonated iminium ion of the dye and the oxyethylene residues of the poly(oxyethylene) segment of the block copolymer. The resulting polymer is a colloidal solution of dye bound to the poly(oxyethylene) phase of the block copolymer. This complex is easily dispersed in a styrenic toner resin to yield a yellow toner composition.

In a fourth embodiment of the present invention, a cationic dye is bound through ion exchange bonding to an anionic polymer or polyelectrolyte. For example, a block copolymer of polystyrene and salts of poly(acrylic acid) or poly(2-methyl-2-acrylamidopropane sulfonic acid) may undergo disproportionation reactions with cationic dyes such as Rhodamine B. The result of the disproportionation reaction is a colloidal solution of the dye bound to the carboxylate anion phase or the acrylamidosulfonate phase of the block polymer. This complex is easily dispersed in a styrenic toner resin to yield a magenta colored toner composition.

The ionophoric or ionomeric polymers that may be used in the present invention are any such polymers that are suitable for use in toner compositions as described herein. For example, the ionophoric polymers may be selected from ionophoric polymers containing cyclic polyethers, ionophoric polymers containing cyclic or bicyclic diaza-crown ethers, and ionophoric polymers with pendant acyclic polyether residues, examples of which are disclosed in U.S. Pat. No. 4,592,989, the entire disclosure of which is incorporated herein by reference. The ionomeric polymers may be selected from ionomeric polymers containing anionic groups, such as sulphonic, carboxylic, and phosphonic acid groups, and ionomeric polymers containing cationic groups, such as ammonium, phosphonium, and sulphonium groups, examples of which are disclosed in U.S. Pat. No. 5,314,778, the entire disclosure of which is incorporated herein by reference. Other ionophoric and ionomeric polymer compounds are known in the art, and may be utilized in the toner compositions of the present invention.

Suitable ionomeric polymers, for example, include but are not limited to ethylene-methacrylic acid copolymers, butadiene-acrylic acid copolymers, sulfonated ethylene-propylene-diene terpolymer, styrene-acrylic acid copolymer, sulfonated polystyrene, alkyl methacrylate-sulfonate copolymers, styrene-based polyampholytes, acid-amine ionomers, mixtures thereof and the like.

Suitable ionophoric polymers, for example, include but are not limited to carbon chain polymers with pendant crown ether groups, such as those derived from 4'-vinyl benzo 18'crown-6; carbon chain polymers with pendant acyclic polyether residues, such as those derived from ethoxylated methacrylate or ethoxylated styrenic monomers; condensation polymers bearing in-chain crown ether, cyclic diaza polyether, or cyclic aza polyether groups; and polymers prepared by various methods containing in-chain acyclic polyether segments, such as polyoxyethylene, poly(2-methyl tetrahydrofuran 2,5-diyl), poly(tetrahydrofuran 2,5-diyl; mixtures thereof and the like.

The ionophoric polymers, which generally are known compositions, can be prepared by a number of processes described in the literature. For example, polymers with pendent cyclic or acyclic polyether functionalities may be prepared by addition polymerization of vinyl or cyclic monomers with pendent cyclic or acyclic polyether groups. Also, analogous polymers can be prepared by polymer derivatization. Polymers with in-chain cyclic polyether residues are generally prepared by polycondensation reactions, while polymers with in-chain acyclic polyether segments are usually prepared by ring opening polymerizations. Moreover, 2,5- poly(tetrahydrofuran)diyl and its congeners ω-poly(cyclo-oxa-alkane)diyls, are prepared by epoxidation and ring expansion of certain alkylene containing polymers. The specific reaction parameters for obtaining the polymers involved are described in the following literature references, the disclosure of each being totally incorporated herein by reference: J. App. Polym. Sci, 20, 773 (1976); Ibid., 20, 1665 (1976); Macromolecules, 12, 1638 (1979); Makromol. Chem. Rapid Commun., 2, 161 (1981); JACS, 102 (27), 7981 (1980); J. Polym. Sci., Polym. Chem., 17, 1573 (1979); W. Dittmann and K. Hamann, Chemiker, 96, (1972), Nouveau Journal DeChemie, 6 (12), 623 (1982); Macromolecules, 13, 339 (1980); Z. Anal. Chem., 313, 407 (1982); J. Polym. Sci., Polymer Chem. Ed., 21, 855 (1983); Ibid. 21, 3101 (1983); Makromol. Chem., 184, 535 (1983); J. Polym. Sci., Pt. Al. 9, 817 (1974); Macromolecules, 12, 1038 (1979); Macromolecules, 6, 133 (1973); and Pure Appl Chem., 57, 111 (1979).

The ionomeric polymers, which generally are also known compositions, can be prepared by a number of processes described in the literature. For example, ionomeric polymers may be prepared by the polymerization of ionizable monomers or by the derivatization of nonionic polymers to incorporate ionizable groups. Such ionomeric polymers are generally prepared by the free-radical homopolymerization or copolymerization of monomers bearing the desired ionizable functionality, or by derivatization of polyamines. The specific reaction parameters for obtaining the polymers involved are described in the following literature reference, the disclosure of which is totally incorporated herein by reference: A. Eisenberg and M. King, Polymer Physics, Vol. 2, Ion-Containing Polymers, Physical Properties and Structure, Academic Press, New York (1977), and references cited therein.

Preferably, the ionophoric or ionomeric polymers are prepared as diblock copolymers.

Two general methods are typically employed for the synthesis of diblock copolymers. First, sequential polymerization by the successive addition of different monomers may be used, wherein the mechanism involved in each step of the polymerization process may be free-radical, cationic or anionic polymerization. Second, the end-to-end linkage of preformed anionic block copolymers may also be used. The diblock copolymers may thus be prepared by these methods, and by the chemical modification of a preformed neutral block copolymer. Because most ionic or ionizable monomers can only be polymerized by free-radical initiators, direct copolymerization usually entails the preparation of the first segment of the polymer with an end-group that is active as a free-radical initiator.

A number of processes for the preparation of block copolymers have been disclosed in the literature, and proceed with the intermediacy of polymer chains end-functionalized as a free-radical initiator. These processes are discussed in the following references, the disclosures of which are totally incorporated herein by reference: C. W. Brown and G. A. Taylor, J. Appl. Polymer Sci., 13,629 (1969). A. Ladousse, C. Filliatre, B. Maillard, C. Manaigand and J. J. Villenave, European Polymer Journal, 15, 987 (1979); B. M. Gaysal, W. T. Short and A. V. Tolbolsky, J. Polym. Sci., A-1, 10, 898 (1972); and J. V. Crivello, D. A. Conlon and J. L. Lee, J. Polym Sci.;PtA, 24, 1197 and 1251 (1986).

The diblock copolymers may be of the form F-block-G where one polymer segment (F)is miscible with the toner polymer resin and the other polymer segment (G)is the ionophoric or ionomeric polymer. The segment miscible with the toner polymer resin may be any polymer typically used as a toner resin and it may be the same or different from the toner resin. Suitable toner resins are discussed below.

As ionic dyes of the present invention may be used any of numerous ionic dyes known in the art. The ionic dyes in the present invention may be either anionic or cationic, depending upon the desired characteristics of the toner composition and the respective ions incorporated into the ion binding polymer composition.

For example, anionic dyes of the present invention may include, but are not limited to, sulfonate salts of phthalocyanine, azo-, pyrazoline and anthraquinone dyes, and mixtures thereof. Examples of such dyes include Acid Alizarin Violet, Acid Yellow 40, Acid Red 4, Acid Blue 25, Acid Violet 7 and copper phthalocyaninetetrasulfonic acid, tetrasodium salt. Preferred anionic dyes are those that contain a sulfonate group. As a further example, cationic dyes of the present invention may include, but are not limited to, Tetrazolium Violet, Rhodamine B, Indoine Blue, Auramine 0, mixtures thereof and the like. Preferred cationic dyes are those that contain an ammonium or quaternary ammonium group.

Figure 1B:
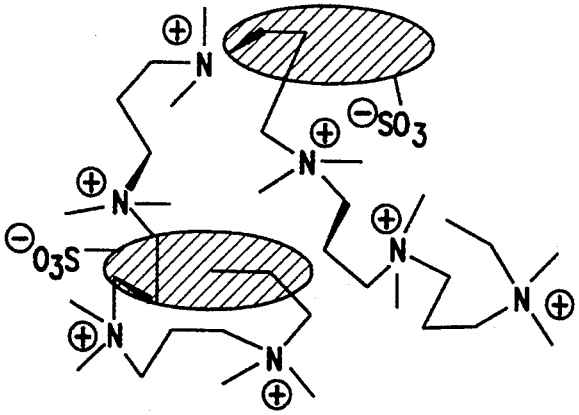

The ionic dyes of the present invention may be bound to the ionophoric or ionomeric polymers by complexation of a counter ion. For example, anionic dyes bearing sulfonate groups can be bound to ionophoric polymers by complexation of the counter ion of the sulfonate anion to the ionophoric group in the polymer composition. Anionic dyes can also be complexed to ionomers by ion exchange of the cation of the dye with cationic groups in the ionomer. As a further example, FIG. 1(*a*) shows an anionic sulfonate salt dye, represented by the shaded oval, complexed by way of its metal cation, $M^+$, to the oxyethylene residues of an ionophoric polymer. FIG. 1(*b*) shows the same anionic sulfonate salt dye complexed to an ionomeric polymer by ion exchange and replacement of its metal cation, $M^+$, with a quaternary nitrogen atom in the ionomer.

Figure 2A:
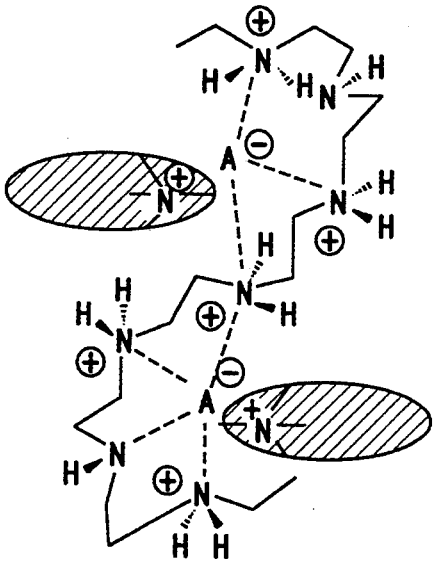
FIG. 2(*a*) shows a cationic dye complexed to a polymer segment.
Figure 2B:
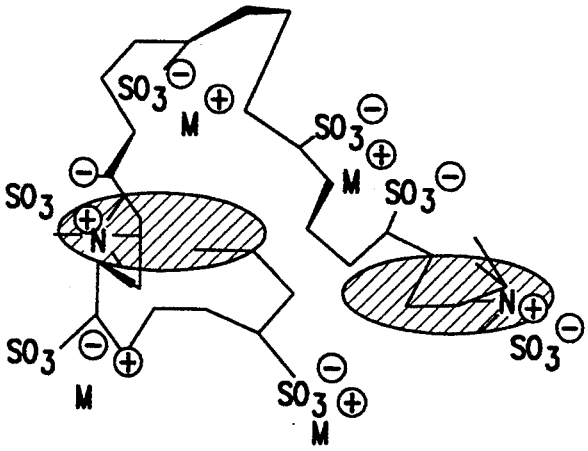

Complexation of cationic dyes to the ionophoric or ionomeric polymers is similar to the complexation of the anionic dyes to such polymers. For example, the cationic dyes of the present invention may be bound to ionophoric polymers by complexation of the counter ion of the corresponding cation in the polymer, or by ion exchange with anionic ionomers and polyelectrolytes. Such complexation of the cationic dyes is shown in FIGS. 2(*a*) and 2(*b*). FIG. 2(*a*) shows a cationic dye wherein the anion of the dye, A-, is bound to cationic nitrogen sites in a poly(alkylammonium) segment. FIG. 2(*b*) shows a cationic dye complexed by ion exchange to the anionic sulfonate group in the polymer composition.

In the present invention, the dyes may be complexed to the ion binding block copolymer by means of hydrogen bonding, apolar bonding, ion dipole bonding, or ionic bonding. The specific means of complexation depending, of course, upon the particular dye and polymer selected.

The aforementioned polymers can be complexed with dyes and other salts by a number of known methods. Thus, for example, the polymer and dye or salt can be dissolved in a common solvent, followed by admixing thereof. Complexation can be achieved at levels as high as 100 percent. That is, up to 100% of the available binding sites in the polymer may actually be occupied.

The in situ precipitation of cationic or anionic dyes in the ionophoric phase of an ion binding polymer is an important variation on molecular binding that will often be effective in the generation of optically clear colloidal compositions. The compositions are characterized in that the dyes are stabilized against thermal and photochemical degradation. Such in situ precipitation may be accomplished where the ion binding polymer is previously complexed with a salt, the anion or cation of which forms an insoluble dye/salt "lake" in the ion binding polymer phase or domain, For example, barium chloride complexed to poly(ethylene oxide) provides a polymer/salt complex that is effective in precipitating anionic dyes in the polymer domain as their barium salts.

Dyes bearing any of a wide variety of cations or anions may be incorporated into the ionomeric or ionophoric polymers. Examples of cations that can be bound to oxyethylene residues in ionophoric polymers described herein include alkali earth salts, alkaline salts, the transition metal salts, and the like, providing the objectives of the present invention are satisfied. Specific examples of cations that can be incorporated into the polymers illustrated herein include, but are not limited to, alkali earth metals like lithium, sodium, potassium, cesium and rubidium; alkaline earth metals such as berylium, calcium, strontium, magnesium, and barium; rare earth metals including germanium, gallium, erbium, lanthanum and praseodymium; transition metals such as titanium, chromium, iron, silver, gold, and mercury; mixtures thereof, and the like. Also useful as cations are metals such as zinc, aluminum and tin. Moreover, as cations, there can be selected ammonium compounds including ammoniums and alkyl ammonium salts of the formula $NH_4^+$, $NHR_3^+$, $NH_2R_2^+$ or $NH_3R^+$ wherein R, $R_2$ and $R_3$ are independent alkyl groups of from 1 to 24 carbons.

Examples of anions that can be incorporated into the cationic polymers described herein include halides, electronegative anions, organic anions, complex anions, electron rich anions and electron poor anions, providing the objectives of the present invention are satisfied. Specific examples of anions that can be incorporated into the polymers illustrated herein include, but are not limited to, iodide, chloride, bromide, fluoride, nitrate, perchlorate, citrate, acetate, picrate, tetraphenyl boride, ferricyanide, ferrocyanide, hexachloroantimonate, hexafluorophosphate, tetrafluoroborate, hydroxide, trifluoromethane sulphonate, hexafluorophosphate, hexafluorosilicate, carboxylate, oximate, mixtures thereof, and the like.

Generally, the ionophoric or ionomeric polymer can be complexed with an ionic dye, another compound such as a salt or a combination thereof. Complexation can range from about 0.5 molar percent to about 100 molar percent depending on the binding capacity of the polymer. Preferably, the complexation is in an amount of from about 20 molar percent to about 90 molar percent, and more preferably the complexation is about 75 molar percent. By molar percent is meant the percentage of the moles of the binding residues of the ionophoric or ionomeric polymer that are complexed by the dye or other additive. Molar percents are used because polymer complexes contain multiple binding sites per polymeric unit and the stoichiometry of binding varies with the mechanism of binding and the nature of the anion, cation or molecule bound. For example, metal cations generally require a minimum of four oxyalkylene residues per binding site yet only two or three carboxylic acid residues are generally required to achieve full coordination.

Because ionomeric polymers are being used, and because those polymers exhibit primary control over the charging characteristics of the toner composition, it may be advantageous to incorporate into those polymers other salts that act as charge enhancing additives. The inclusion of such additives modulates the dielectric properties of the composite, and thus the charging and admix properties of the resultant toner or developer composition. As disclosed in U.S. Pat. Nos. 4,592,989 and 5,314,778, the charge enhancing compositions disclosed therein can be incorporated into the toner composition. That is, additional non-dye, charge enhancing compounds may be complexed to the ion binding polymer to adjust the charging characteristics of the final toner composition. Such compositions may be incorporated into the toner in various desired amounts, providing the objectives of the present invention are achieved. Generally, the charge enhancing compositions are present in the toner in an amount of from about 0.5 percent to about 10 percent by weight, and preferably in an amount of from about 5 percent by weight. The non-dye additives are generally complexed to the polymer in an amount of from about 2 molar percent to about 90 molar percent. Preferably, the complexation is from about 5 molar percent to about 50 molar percent, and more preferably is about 25 molar percent. However, one skilled in the art will recognize that the percent complexation of the polymers will vary where both ionic dyes and charge enhancing additives are being complexed to the polymer.

Numerous known methods may be selected for preparing the toner and developer compositions of the present invention. Thus, the toner compositions may be prepared by mixing a polymeric toner resin, the ion binding polymeric dye complex compositions of the present invention and other internal or external toner additives, or by melt blending a toner resin, other additives, and the ion binding polymeric dye complex of the present invention, followed by mechanical attrition. Other processes for preparing the toner compositions of the present invention may be selected, including, for example, spray drying and suspension polymerization. Preferably, the toner composition is prepared such that the ionic dye polymer complex is homogeneously dispersed in the toner composition.

Generally, the polymer dye complex of the present invention is present in the toner composition in an amount of from about 1 percent to about 50 percent by weight. Preferably, the polymer dye complex is present in an amount of from about 2 percent to about 30 percent by weight. Of course, the composition will vary depending on the specific dye and polymers used and the percent of complexation of the polymer.

Various suitable toner resins may be selected for the toner compositions of the present invention. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyester resins, and mixtures thereof.

Generally, toner resins with a relatively high percentage of styrene are preferred. The styrene resin may be a homopolymer of styrene or copolymers of styrene with other monomeric groups. Any of the above suitable typical monomeric units may be copolymerized with styrene by addition polymerization. Styrene resins may also be formed by additional polymerization processes, including free radical, anionic, and cationic polymerization of mixtures of two or more unsaturated monomeric materials with styrene monomer.

Additionally, esterification products of a dicarboxylic acid and a diol comprising a diphenol may be used as a preferred resin material for the toner compositions of the present invention. These materials are illustrated in U.S. Pat. No. 3,655,374, the disclosure of which is totally incorporated herein by reference. Other preferred polyester materials selected for the polymer toner resin of the present invention include those described in U.S. Pat. No. 4,049,447 and Canadian Patent No. 1,032,804, the disclosure of each of these patents being totally incorporated herein by reference.

The toner resins are generally present in the toner of the invention in an amount of from about 40% to about 98% by weight, and more preferably from about 70% to about 98% by weight, although they may be present in greater or lesser amounts, provided that the objectives of the invention are achieved. As described above, for example, toner resins of the invention can be melt blended or otherwise mixed with the polymer-dye complex, additional colorants, charge carrier additives, surfactants, emulsifiers, pigment dispersants, flow additives, and the like. The resultant product can then be pulverized by known methods such as milling to form toner particles. The toner particles preferably have an average volume particle diameter of from about 5 microns to about 25 microns, and more preferably from about 5 microns to about 15 microns.

Additional colorants may be incorporated into the toner and developer compositions of the present invention. However, due to the superior results achieved using the ionic dye-polymer complex of the present invention, the dye-polymer complex is preferred. If additional colorants are to be used, they may be selected from various suitable colorants, including suitable colored pigments, dyes, and mixtures thereof including Carbon Black, such as Regal 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

If additional colorants are used, the colorant is incorporated in an amount sufficient to impart the desired color to the toner. In general, pigment or dye is employed in an amount ranging from about 2% to about 60% by weight, and preferably from about 2% to about 7% by weight for color toner and about 5% to about 60% by weight for black toner. One skilled in the art will recognize, however, that the composition of the colorant will have to be adjusted based on the colorant effect of the polymer/dye complex of the present invention.

Various known suitable effective positive or negative charge enhancing additives can be selected for incorporation into the toner compositions of the present invention. However, as noted above, the ionophoric or ionomeric polymer to which the ionic dye is bound may be used to control the charging characteristics of the toner composition. Additional charge enhancing additives may thus be used to adjust the charging characteristics as necessary to achieve desired properties. Preferably, any additional charge enhancing additives are present in an amount of about 0.1% to about 10% by weight, and more preferably about 1% to about 3% by weight. Such charge enhancing additives may be in addition to any charge enhancing additives which may be complexed to the ionophoric or ionomeric polymer, as described in U.S. Pat. Nos. 4,592,989 and 5,314,788, which is incorporated herein by reference. Examples of additional charge enhancing additives include quaternary ammonium compounds inclusive of alkyl pyridinium halides; alkyl pyridinium compounds, such as those disclosed in U.S. Pat. No. 4,298,672, the disclosure of which is totally incorporated herein by reference; organic sulfate and sulfonate compositions, such as those disclosed in U.S. Pat. No. 4,338,390, the disclosure of which is totally incorporated herein by reference; cetyl pyridinium tetrafluoroborates; distearyl dimethyl ammonium methyl sulfate; zinc and aluminum salts such as Bontron E84 TM or E88 TM (Orient Chemical Industries, Ltd.), respectively; and the like.

Additionally, other internal and/or external additives may be added in known amounts for their known functions.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other suitable carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. However, best results are obtained when about 1 part carrier to about 10 parts to about 200 parts by weight of toner are mixed.

Toners of the invention can be used in known electrostatographic imaging methods. Thus, for example, the toners or developers of the invention can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

When used in toner and developer compositions, the ionic dye complexes of embodiments of the present invention may exhibit fully effective and rapid positive and negative admixing charging properties.

One skilled in the art will recognize that the dyes, toners and developer compositions discussed above may be adjusted as necessary to achieve a toner or developer composition with specific characteristics. The invention will now be described in detail with reference to specific preferred embodiments thereof. All parts and percentages are by weight unless otherwise indicated.

EXAMPLES

Example 1

This example describes the preparation of a positive charging, yellow toner composition containing an ionophoric block copolymer complexed with an anionic dye.

This toner composition is prepared by melt blending 80% by weight of a styrene/butadiene resin (89/11 by weight), available as Pliotone from Goodyear Chemical, with 20% by weight of a block copolymer of styrene and ethylene oxide, (PS-b-PEO, 60/40 molar), complexed fully with an anionic dye typified by the potassium salt of Acid yellow 40. The fully complexed block copolymer is comprised of 63% by weight of PS-b-PEO, 60/40 molar, and 37% by weight of the potassium salt of Acid Yellow 40 and is prepared by blending PS-b-PEO, (60/40 molar) with the potassium salt of Acid yellow 40 in a solution of toluene/tetrahydrofuran/methanol (85/15/5 by weight). This solution is precipated in hexane to isolate the dye-complexed block copolymer.

After melt processing, the resulting mixture may then be attrited and classified to yield a toner composition that charges positively against several carriers and that contains the ionic dye bound to the ionophoric polymer. Thus, for example, when this toner is blended with a carrier consisting of a ferrite core coated with a copolymer derived from fluorovinyl and chlorovinyl monomers (FPC 461, available from Firestone Plastics) and mixed, a positive triboelectric charge in excess of 20 $\mu C/g$ of toner can be achieved.

Example 2

This example describes the preparation of a negative charging, magenta toner composition containing an acrylic acid block copolymer complexed by hydrogen bonding to a cationic dye with an auxiliary carboxylic acid group.

This toner composition is prepared by melt blending 80% by weight of a styrene/butadiene resin (89/11 by weight), available as Pliotone from Goodyear Chemical, with 20% by weight of a block copolymer of styrene and acrylic acid co-methylacrylate, (PS-b-PAA/MA, 72-b-22/6 molar), complexed fully with an ionic dye typified by Rhodamine B. Full complexation is assumed to be one mole of dye to 4 moles of acrylic acid residues, with binding being a result of hydrogen bonding between the carboxylic acid group on the dye and the carboxylic acid residues in the block copolymer. The fully complexed block copolymer is thus comprised of 78% by weight of PS-b-PAA/MA, 72-b-22/6 molar, and 22% by weight of Rhodamine B and is prepared by blending PS-b-PAA/MA, (72/22/6 molar) with Rhodamine B in a solution of toluene/tetrahydrofuran/methanol (85/15/5 by weight). This solution is precipated in hexane to isolate the dye-complexed block copolymer.

After melt processing, the resulting mixture may then be attrited and classified to yield a toner composition that charges negatively against several carriers and that contains the ionic dye bound to the ionophoric polymer. Thus, for example, when this toner is blended with a carrier consisting of a ferrite core coated with a methyl terpolymer comprised of 80.9 percent methylmethacrylate, 14.3 percent styrene, and 4.8 percent vinyltriethoxysilane. and mixed, a negative triboelectric charge in excess of 15 μC/g of toner can be achieved.

Example 3

This example describes the preparation of a positive charging toner composition containing an ionophoric block copolymer complexed with an admix-enhancing ionic salt and an anionic dye.

This toner composition is prepared by melt blending 80% by weight of a styrene/butadiene resin (89/11 by weight), available as Pliotone from Goodyear Chemical, with 20% by weight of a block copolymer of styrene and ethylene oxide, (PS-b-PEO, 60/40 molar), partially complexed (75% of binding capacity) with an anionic dye typified by the potassium salt of Acid yellow 40 and partially complexed (25% of binding capacity) with potassium hexafluorophosphate. The mixed complex of block copolymer dye and salt is comprised of 67% by weight of PS-b-PEO, 60/40 molar, 30% by weight of the potassium salt of Acid Yellow 40 and 3% by weight of $KPF_6$ and is prepared by blending PS-b-PEO, (60/40 molar) with the potassium salt of Acid yellow 40 and $KPF_6$ in a solution of toluene/tetrahydrofuran/methanol (85/15/5 by weight). This solution is precipated in hexane to isolate the complexed block copolymer.

After melt processing, the resulting mixture may then be attrited and classified to yield a toner composition that charges positively against several carriers and that contains the ionic dye and $K^+PF_6^-$ bound to the ionophoric polymer. Thus, for example, when this toner is blended with a carrier consisting of a ferrite core coated with a copolymer derived from fluorovinyl and chlorovinyl monomers (FPC 461, available from Firestone Plastics) and mixed, a positive triboelectric charge in excess of 20 μC/g of toner can be achieved. The admix of this toner is rapid, i.e., less than two minutes as opposed to greater than fifteen minutes for a control toner prepared, without the ionophoric polymer or potassium hexafluorophosphate, by simply melt processing 95% by weight of Pliotone with 5% by weight of the potassium salt of Acid yellow 40.

Example 4

This example describes the preparation of a negative charging, magenta toner composition containing an acrylic acid block copolymer complexed by hydrogen bonding to a cationic dye bearing an auxiliary carboxylic acid group and by ion-dipole forces to an admix-enhancing, tribo active lewis acid salt.

This toner composition is prepared by melt blending 80% by weight of a styrene/butadiene resin (89/11 by weight), available as Pliotone from Goodyear Chemical, with 20% by weight of a block copolymer of styrene and acrylic acid co-methylacrylate, (PS-b-PAA/MA, 72-b-22/6 molar), partially complexed with an ionic dye typified by Rhodamine B and partially complexed with zinc chloride. The mixed complex of block copolymer is thus comprised of 81% by weight of PS-b-PAA/MA, 72-b-22/6 molar, 17.4% by weight of Rhodamine B and 1.6% by weight of $ZnCl_2$ and is prepared by blending PS-b-PAA/MA, (72/22/6 molar) with Rhodamine B and $ZnCl_2$ in a solution of toluene/-tetrahydrofuran/methanol (85/15/5 by weight). This solution is precipated in hexane to isolate the dye-complexed block copolymer.

After melt processing, the resulting mixture may then be attrited and classified to yield a toner composition that charges negatively against several carriers and that contains the ionic dye and $ZnCl_2$ bound to the ionomeric polymer. Thus, for example, when this toner is blended with a carrier consisting of a ferrite core coated with a methyl terpolymer comprised of 80.9 percent methylmethacrylate, 14.3 percent styrene, and 4.8 percent vinyltriethoxysilane. and mixed, a negative triboelectric charge in excess of 15 μC/g of toner can be achieved. The admix of this toner is rapid, i.e., less than two minutes as opposed to greater than fifteen minutes for a control toner prepared, without the ionomeric polymer or zinc chloride, by simply melt processing 95% by weight of Pliotone with 5% by weight of the Rhodamine B.

Example 5

This example describes the preparation of a positive charging, cyan toner composition containing a cationic block copolymer complexed by ion exchange with an anionic dye.

This toner composition is prepared by melt blending 80% by weight of a styrene/butadiene resin (89/11 by weight), available as Pliotone from Goodyear Chemical, with 20% by weight of a block copolymer of styrene and 4-vinylpyridinium, (PS-b-4VP+), 78/22 molar), fully ion-exchanged with an anionic dye typified by copper phthalocyaninetetrasulfonate. The fully complexed block copolymer is comprised of 35% by weight of PS-b-4VP+, 78/22 molar, and 65% by weight of the copper phthalocyaninetetrasulfonate and is prepared by blending PS-b-4VP+Cl−, (78/22 molar) with copper phthalocyaninetetrasulfonic acid tetrasodium salt in a solution of toluene/tetrahydrofuran/methanol (85/15/5 by weight). This solution is filtered to remove insoluble sodium chloride and is precipitated in hexane to isolate the dye-complexed block copolymer.

After melt processing, the resulting mixture may then be attrited and classified to yield a toner composition that charges positively against several carriers and that contains the ionic dye bound to the ionophoric polymer. Thus, for example, when this toner is blended with a carrier consisting of a ferrite core coated with a copolymer derived from fluorovinyl and chlorovinyl monomers (FPC 461, available from Firestone Plastics) and mixed, a positive triboelectric charge in excess of 15 μC/g of toner can be achieved.

Example 6

This example describes the preparation of a positive charging, toner composition containing an ionophoric block copolymer complexed by hydrogen bonding forces with a cationic dye.

This toner composition is prepared by melt blending 80% by weight of a styrene/butadiene resin (89/11 by weight), available as Pliotone from Goodyear Chemical, with 20% by weight of a block copolymer of styrene and ethylene oxide, (PS-b-PEO, 60/40 molar), complexed fully with a cationic dye typified by Auramine 0. The fully complexed block copolymer is comprised of 88.2% by weight of PS-b-PEO, 60/40 molar, and 11.8% by weight of Auramine 0 and is prepared by blending PS-b-PEO, (60/40 molar) with Auramine 0 in a solution of toluene/tetrahydrofuran/methanol (85/15/5 by weight). This solution is precipated in hexane to isolate the dye-complexed block copolymer.

After melt processing, the resulting mixture may then be attrited and classified to yield a toner composition that charges positively against several carriers and that contains the ionic dye bound to the ionophoric polymer. Thus, for example, when this toner is blended with a carrier consisting of a ferrite core coated with a copolymer derived from fluorovinyl and chlorovinyl monomers (FPC 461, available from Firestone Plastics) and mixed, a positive triboelectric charge in excess of 20 $\mu$C/g of toner can be achieved.

Example 7

This example describes the preparation of a positive charging toner composition containing an ionomeric block copolymer complexed by ion-exhange with a cationic dye.

This toner composition is prepared by melt blending 80% by weight of a styrene/butadiene resin (89/11 by weight), available as Pliotone from Goodyear Chemical, with 20% by weight of a block copolymer of styrene and acrylate co-methylacrylate, (PS-b-PAA/MA, 72-b-22/6 molar), fully ion-exchanged with a cationic dye typified by Indoine Blue. The fully complexed block copolymer is thus comprised of 49% by weight of PS-b-PAA/MA, 72-b-22/6 molar and 51% by weight of Indoine Blue and is prepared by blending PS-b-PAA-$Na^+$/MA, (72/22/6 molar) with Indoine blue in a solution of toluene/tetrahydrofuran/methanol (85/15/5 by weight). This solution is filtered to remove sodium chloride and is precipated in hexane to isolate the dye-complexed block copolymer.

After melt processing, the resulting mixture may then be attrited and classified to yield a toner composition that charges positively against several carriers and that contains the cationic dye bound to the ionomeric polymer. Thus, for example, when this toner is blended with a carrier consisting of a ferrite core coated with a methyl terpolymer comprised of 80.9 percent methylmethacrylate, 14.3 percent styrene, and 4.8 percent vinyltriethoxysilane. and mixed, a negative triboelectric charge in excess of 15 $\mu$C/g of toner can be achieved.

What is claimed is:

1. A toner composition comprising a resin, a charge enhancing additive, an ion binding polymer, and at least one ionic dye complexed to the ion binding polymer, wherein said ionic dye is different from the charge enhancing additive and is stabilized and dispersed in the toner composition.

2. A toner composition according to claim 1, wherein said ion binding polymer comprises an ionophoric polymer.

3. A toner composition according to claim 1, wherein said ion binding polymer comprises an ionomeric polymer.

4. A toner composition according to claim 1, wherein said ionic dye is a cationic dye.

5. A toner composition according to claim 1, wherein said ionic dye is an anionic dye.

6. A toner composition according to claim 1, wherein the toner composition is substantially free of dyes or pigments other than the ionic dye.

7. A toner composition according to claim 1, wherein the complexed ion binding polymer is present in an amount of from about 1% by weight to about 50% by weight of the toner composition.

8. A toner composition according to claim 1, wherein said complexed ion binding polymer is present in an amount of from about 2% by weight to about 30% by weight of the toner composition.

9. A toner composition according to claim 4, wherein the cationic dye is a dye containing an ammonium or quaternary ammonium group.

10. A toner composition according to claim 5, wherein said anionic dye is a dye containing a sulfonate group.

11. A toner composition according to claim 5, wherein said anionic dye is selected from the group consisting of Acid Alizaran Violet, Acid Yellow 40, Acid Red 4, Acid Blue 25, Acid Violet 7, and copper phthalocyanine tetrasulphonic acid tetrasodium salt.

12. A toner composition according to claim 1, wherein the resin is selected from the group consisting of polyamides, epoxies, polyurethanes, vinyl resins, polycarbonates, and polyesters.

13. A toner composition according to claim 1, wherein the resin comprises polystyrene.

14. A toner composition according to claim 3, wherein said ionomeric polymer is selected from the group consisting of ethylene-methacrylate acid copolymers, butadiene-acrylic acid copolymers, sulfonated ethylene-propylene-diene terpolymer, styrene-acrylic acid copolymer, sulfonated polystyrene, alkyl methacrylatesulfonate copolymers, styrene-based polyampholytes, and acid-amine ionomers.

15. A toner composition according to claim 3, wherein said ionomeric polymer contains an anionic group selected from the group consisting of sulphonic, carboxylic, and phosphonic groups.

16. A toner composition according to claim 3, wherein the ionomeric polymer contains a cationic group selected from the group consisting of ammonium, phosphonium, and sulphonium groups.

17. A toner composition according to claim 2, wherein the ionophoric polymer is selected from the group consisting of ionophoric polymers containing in-chain or pendant cyclic polyethers, cyclic or bicyclic aza-crown ethers, or acyclic polyether residues.

18. A toner composition according to claim 1, wherein the ion binding polymer is complexed with the ionic dye in an amount of from about 0.5 molar percent to about 100 molar percent of available binding sites.

19. A toner composition according to claim 1, wherein said ion binding polymer is complexed with the ionic dye in an amount of from about 20 molar percent to about 90 molar percent of available binding sites.

20. A toner composition according to claim 1, wherein said ion binding polymer is complexed with the ionic dye in an amount of about 75 molar percent of available binding sites.

21. A toner composition according to claim 1, wherein said charge enhancing additive is selected from the group consisting of internal additives and external additives and wherein said charge enhancing additive is not complexed to said ion binding polymer.

22. A toner composition according to claim 1, wherein said charge enhancing additive is in the form of a dipolar molecule or salt and is complexed to said ion binding polymer.

23. A toner composition according to claim 22, wherein said ion binding polymer is complexed with said ionic dye and said charge enhancing additive in an amount of from about 0.5 molar percent to about 100 molar percent of available binding sites.

24. A developer composition comprising the toner composition of claim 1, and carrier particles.

25. A developer composition according to claim 24, wherein the carrier particles contain a coating.

26. A developer composition according to claim 1, wherein the toner composition has a positive charge.

27. A developer composition according to claim 1, wherein the toner composition has a negative charge.

* * * * *